United States Patent [19]

Barr

[11] 4,035,788

[45] July 12, 1977

[54] INCIPIENT FIRE DETECTOR

[75] Inventor: Laurence Gibson Barr, Mission Viejo, Calif.

[73] Assignee: Celesco Industries Inc., Costa Mesa, Calif.

[21] Appl. No.: 649,344

[22] Filed: Jan. 15, 1976

[51] Int. Cl.[2] ..... G08B 17/10

[52] U.S. Cl. ..... 340/237 S; 250/381; 313/54

[58] Field of Search ..... 340/237 S; 250/381, 250/382, 384, 385, 389, 390; 313/54

[56] References Cited

U.S. PATENT DOCUMENTS

| | | | |
|---|---|---|---|
| 3,154,773 | 10/1964 | Meili et al. | 340/237 S |
| 3,353,170 | 11/1967 | Meili et al. | 340/237 S |
| 3,953,844 | 4/1976 | Barr et al. | 340/237 S |

*Primary Examiner*—John W. Caldwell

*Assistant Examiner*—Daniel Myer

*Attorney, Agent, or Firm*—Finnegan, Henderson, Farabow & Garrett

[57] ABSTRACT

The improved incipient fire detector employs an ionization particulate detector in combination with a particulate collector to monitor selectively small particulates in the atmosphere which are indicative of an incipient fire condition. During an incipient fire condition, prior to ignition, a large mass of particulates less than 5 microns in size is generated by combustible material thereby increasing the concentration of such size particulates in the atmosphere. The detector is designed to collect particulates less than 5 microns in size, rejecting those above this size, and channel the collected particulates at a controlled rate of flow into an ionization chamber wherein the concentration of such particulates is measured.

4 Claims, 4 Drawing Figures

INCIPIENT FIRE DETECTOR

BACKGROUND OF THE INVENTION

The present invention is directed to an improved incipient fire detector employing a flow-through ionization particulate detector or sensor which is supplied with a controlled rate of flow of small particulates previously separated by aerodynamic particulate collector.

Fire detection systems and devices available today require the presence of flame, or the attainment of a preselected temperature level or the like, or rely instead on detection of fly ash or "smoke." A typical device which detects smoke and other combustion products uses an ionization particulate detector comprising two ionization chambers. A first, measuring chamber is exposed to the atmosphere where as a second, reference chamber is isolated from any fire-produced, atmospheric smoke or other combustion products. The reference chamber is employed to minimize the effects of normal ambient fluctuations in temperature, humidity and pressure on the operation of the measuring chamber.

Both ionization chambers employ a small radioactive source of ionization current. As the density of mass products of a fire increase in the atmosphere, they inhibit the travel of the ionized air molecules in the measuring chamber from the source to a spaced electrode. The resulting alteration in the ionization current of the measuring chamber in comparison to the current in the reference chamber can be used to indicate the existence of smoke and other combustion products.

In practice, variations in ionization current level due to smoke and other combustion products are extremely small. As a consequence, highly sensitive circuits are needed to reliably sense these changes. In an effort to enhance reliability, the measuring and reference ionization chambers of the prior art are often connected in series across a direct current voltage source. In addition, the reference chamber is reduced in size and redesigned to operate just below its physical and electrical saturation point. As a consequence, while small ambient changes in the atmospheric temperature, pressure or humidity have a nearly equal effect on both chambers, increased resistance in the measuring chamber due to the presence of fire-produced particles has an amplified effect on the total voltage distribution across both chambers which effect can more readily be detected as indicative of an existing fire.

Nevertheless, even these more advanced prior art ionization particulate detectors have inherent limitations which seriously affect their reliability and commercial utility. For one, the use of different sized or unbalanced ionization chambers results in saturation of the limited range reference chamber when the two chambers are exposed to extreme atmospheric temperature, pressure or humidity changes as can be expected when the detectors are called upon for service in aircraft, spacecraft or the like. In addition, such prior art detectors are adversely affected by uncontrolled variations in air current which can increase the density of particles within the measuring chamber or carry away the radiation field before it can ionize the air molecules which in either case results in a decrease in ionization current and accordingly a false alarm. Such uncontrolled variations in air current are caused, for instance, by the operation of an air conditioner or movement near the detector. As a consequence, diffusion shields are regularly positioned to protect the measuring ionization chambers from the effects of uncontrolled air current variations. These diffusion shields allow for entry of atmospheric particles to the measuring chamber only by the process of convection. Since the reaction time of the detector is dependant in part on the rate of air turn-over in the measuring chamber, the usefulness of detectors using diffusion shields is reduced proportionate to the inherent limitations of the convection process to enable smoke and other combustion products to enter and leave the measuring ionization chamber.

Even with a diffusion shield, the sensitivity of the measuring ionization chamber is further adversely affected by the presence of dust in the ambient atmosphere. Dust particles gather on both the radiation source and electrode of the measuring chamber resulting in a marked premature decrease in ionization current. Furthermore, dust suspended in the chamber itself acts to inhibit ion flow which results in a decrease of ionization current.

Screens and filters provide only a limited relief and introduce the added economic burden of keeping the screens and filters clean. Redesign of the radiation source reported in U.S. Pat. No. 3,353,170 provides only a partial solution.

A recently-developed fire detector system, instead of sensing smoke or other combustion products, keys on detecting micron-sized particulates known to be released into the air when combustible materials approach a state of fire, but before a state of fire actually exists. Such a device is disclosed in U.S. patent application Ser. No. 350,091, U.S. Pat. No. 3,953,844, filed on Apr. 11, 1973, by the present inventor as co-inventor and assigned to the assignee of the present invention. According to the general teachings of that application, a particulate collector is employed to allow only selectively small particulates of the variety typically generated in an incipient fire condition to impinge a crystal detector and thereby provide detection of those particulates to indicate the existence of the incipient fire condition.

The present invention improves upon the incipient detector of patent application Ser. No. 350,091 and effectively combines the aerodynamic particular collector disclosed therein with the innovative use of an ionization particle detector to result in a highly reliable, sensitive, commercially acceptable incipient fire detector.

SUMMARY OF THE INVENTION

The fire detector of the present invention teaches a successful combination of an aerodynamic particulate collector with a flow-through ionization particulate detector to sense the occurrence of an increase in particulate emissions due to an incipient fire condition. The detector generates a signal as a result of such detection which signal indicates that there exists an impending hazardous condition.

To achieve the objects of and in accordance with the purposes of the invention, as embodied and broadly described herein, the improved incipient fire detector of this invention comprises means for aerodynamically collecting from a fluid flow, particulates having a size less than 5 microns and rejecting substantially all particulates having a size above 5 microns; a flow-through ionization particulate detector for sensing the particulates collected by said collecting means; means for directing said collected particulates from said collecting means through said ionization particulate detector at a controlled rate of flow; and means for providing an output from said ionization particulate detector to permit processing the number of collected particulates sensed by said ionization particulate detector as an indication of an incipient fire condition.

Preferably, said aerodynamic collecting means includes an outer surface, said outer surface being closed at the portion facing the direction of planned flow of said fluid; an opening formed in the outer surface portion facing opposite to the direction of planned flow; and said collector being sized to collect into said opening particulates having a size less than 5 microns and to reject substantially all particulates having a size above 5 microns.

It is also preferred that said ionization particulate detector include a first flow-through ionization chamber for sensing the particulates collected by said collecting means and a second ionization chamber for serving as a reference to said first chamber.

It is also preferred that said first and second ionization chambers are geometrically identical.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
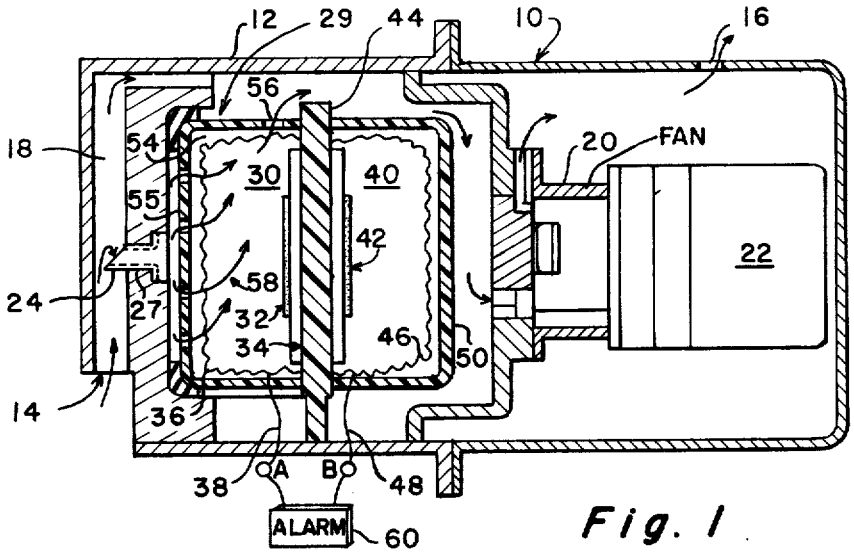
FIG. 1 is a diagram of the preferred embodiment of an improved incipient fire detector constructed in accordance with the teachings of this invention.

Referring now to FIG. 1, there is presented a diagram of an improved incipient fire detector indicated generally by the numeral 10. The detector 10 includes an outer housing 12 having an inlet 14, an outlet 16 and a main passageway 18. As embodied herein, passageway 18 is formed in housing 12 and is in fluid flow communication with the inlet 14 for passing a fluid sample through the detector 10. Main passageway 18 can be formed as the interior of a tube inserted in housing 12. Alternatively, where housing 12 is made solid, main passageway 18 can be conveniently formed by drilling an appropriately-sized hole through the housing.

In accordance with the invention, there are means provided for aerodynamically collecting from a fluid flow, particulates having a size less than 5 microns and rejecting substantially all particulates having a size above 5 microns. As embodied herein, this collecting means includes an aerodynamic particulate collector 24. The aerodynamic particulate collector 24 is preferably a particulate collector as disclosed in the abovementioned U.S. patent application Ser. No. 350,091, U.S. Pat. No. 3,953,844, filed on Apr. 11, 1973 [hereinafter referred to as the Barr application]. In accordance with the teachings of the Barr application, collector 24 is provided with an outer surface that is closed at the portion which faces the direction of planned flow of the fluid past the collector. The opening for collecting particulates from the fluid is formed in the outer surface portion of the collector which faces opposite to the direction of planned flow.

Figure 2:
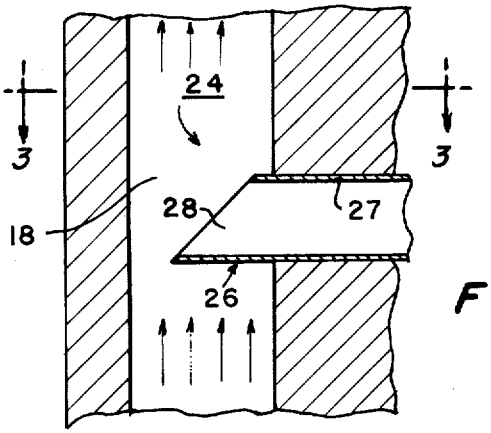
FIG. 2 is a side view, in cross-section, of a preferred particulate collector used in the aforesaid incipient fire detector.
Figure 3:
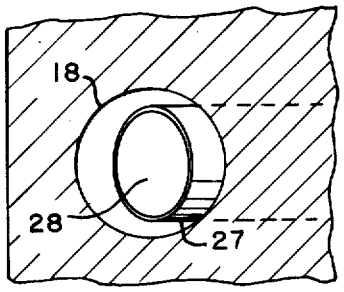
FIG. 3 is a sectional view taken along line 3—3 of FIG. 2 looking upstream through the main passageway of the nozzle block.
Figure 4:
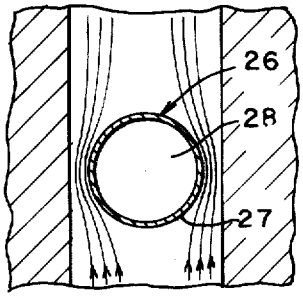
FIG. 4 is a plan view taken along line 4—4 of FIG. 3 looking down the longitudinal axis of the collector tube.

As here embodied, and with further referece to FIGS. 2, 3 and 4, it is seen that the front surface 26 of collector 24 which faces upstream is closed. As taught in the Barr application and explained in greater detail hereinafter, this surface preferably is formed as a curved surface to aid in deflecting the flow of fluid and particulates past the collector. As embodied herein, collector 24 is formed as a tube 27 which extends into passageway 18, and has an opening 28 which is formed by cutting the tube at an oblique angle to its longitudinal axis. This opening is preferably of a general elliptical shape when the collector tube 24 is viewed as in FIG. 3. As shown, opening 28 faces in the downstream direction with reference to the planned flow of fluid through passageway 18. The dimensions of collector 24 are selected as is taught in the Barr application for aerodynamically collecting particulates in passageway 18 having a size less than 5 microns and rejecting substantially all particulates having a size above 5 microns. For a more detailed description of the construction and operation of particulate collector 24, reference should be made to the Barr application, which is hereby specifically incorporated by reference.

In accordance with the invention, a flow through ionization particulate detector 29 is provided for sensing particulates collected by said collecting means. As embodied herein, the ionization particulate detector 29 comprises a first ionization chamber 30 for sensing particulates collected by said collector means. Ionization chamber 30 is preferably of a variety commonly known and used in the fire detector art and includes a source of radioactive material 32 mounted on an insulating base 34. Ionization chamber 30 further includes an outer housing 36 for receiving air molecules ionized by radioactive material 32. Housing 36 acts as an electrode and establishes an ionization current on output line 38 of housing 36. In addition, housing 36 is designed to allow particulates and air molecules to pass through ionization chamber 30. For example, housing 36 may be constructed from an electrically conductive screen or mesh which particulates can permeate. In the alternative, housing 36 may be constructed from a solid material having plural openings to provide a continuous flow of particles and air molecules through the ionization chamber 30.

As embodied herein, the ionization particulate detector 29 further comprises a second ionization chamber 40 serving as a reference for said first ionization chamber 30. Ionization chamber 40 is also preferably of a variety commonly known and used in the fire detector art and includes a source of radioactive material 42 mounted on insulating base 34. Ionization chamber 40 further includes an outer housing 46 designed in the same manner as outer housing 36 for receiving air molecules ionized by radioactive material 42. By receiving the ionized air molecules, housing 46 acts as an electrode and establishes an ionization current on output line 48 of housing 36. A shield 50 surrounds ionization chamber 40 to prevent particulates in the air from entering and thereby effecting the operation or ionization chamber 40. A labyrinth groove or leak path 44 is provided between shield 50 and base 34 which allows access to the ambient atmosphere and accordingly ionization chamber 40 is sensitive to atmospheric changes in temperature, pressure and humidity. However, leak path 44 is sufficiently small to inhibit migration of the collected particulates, dust or other atmospheric particles into chamber 40.

In the preferred embodiment of the invention, ionization chamber 40 is geometrically identical to and functions in the identical way with ionization chamber 30. In this way, the two chambers are balanced and any changes in ionization current caused by ambient fluctuations in temperature, humidity or pressure are equal in both chambers. In addition, since shield 50 isolates ionization chamber 40 from variations in air particle content, ionization chamber 40 provides a reference standard with which ionization chamber 30, which is not so isolated, can be compared.

In accordance with the invention, means are provided for directing collected particulates from the collecting means through the ionization particulate detector 29 at a controlled rate of flow. As embodied herein, said directing means includes main passageway 18 for containing a flow of air sample through housing 12. In addition, the output of tube 27 leads into a cavity 54 for housing ionization chamber 30. Cavity 54 surrounds electrode 36 and has an outlet 56 leading to main passageway 18. Fan 20 is driven by motor 22 and located in main passageway 18 to circulate fluid. adjacent opening 14 into main passageway 18, past collector 24 and out outlet 16.

In addition fan 20 causes a flow of air molecules and of particulates less than 5 micron in size separated by collector 24, to pass through tube 27 and into cavity 54. The flow exists cavity 54 at outlet 56 and rejoins the main fluid flow in main passageway 18. First ionization chamber 30 is located in cavity 54 directly in the path of this flow as indicated by arrows 58. To assure uniform flow through ionization chamber 30, a deflector 55 is positioned in cavity 54 between collector tube 27 and chamber 30. The rate of flow through ionization chamber 30 is controlled by the velocity of the air flow passing the collector 24 and the geometry of the collector tube 27. The effect on rate of flow controlled by the geometry of collector tube 27 is described in the above-mentioned Barr application.

In accordance with the invention, means are included to provide an output from the ionization particulate detector to permit processing the number of collected particulates sensed by the ionization particulate detector. As embodied herein, this output means is indicated in FIG. 1 by terminals A and B. An alarm 60 is shown connected to terminals A and B. Alarm 60 may encompass any conventional processing circuits known in the fire detection art which activate a monitor in response to the ionization current on line 38 from first ionization chamber 30 reaching a predetermined threshold valve above the current on line 48 from reference chamber 40, indicative of the existence of a hazardous condition. As another example, the outputs 38 and 48 of ionization chambers 30 and 40, respectively may be series-connected with only the difference in ionization current between the two chambers being measured. Alarm 60 may then consist of a current meter whose output provides a continuous monitor of the degree of fire hazard present.

As another alternative, the series-connected difference output currents from chambers 30 and 40 may be converted to a signal which varies in frequency with a change in current and that signal applied to the electronic processor described in FIG. 6 of the above-mentioned Barr application. In summary, the outputs on lines 38 and 48 are applied to alarm 60 with the end result being an indication on a display, recording device, control device, or the like, of an incipient fire condition. The particular circuitry employed is not in itself a critical element of the present invention.

In operation of the present invention, a continuous air sample flows into main passageway 18 of housing 12 through inlet 14. The collector 24 aerodynamically separates out of the air sample flow in main passageway 18 particulates having a size less than 5 microns including a sub-micron particulates and rejects substantially all particulates having a size above 5 microns. The rejected particulates continue through main passageway 18, completely bypassing ionization chamber 30, and are discharged from housing 12 at outlet 16. The portion of the flow containing the selected particulates which is tapped from the sample, flows through collector tube 27 and enters cavity 54 wherein ionization chamber 30 is located. This portion of the flow in seeking the most direct route to outlet 56 passes through electrode 36 of ionization chamber 30, then exists from this chamber at outlet 56, reunites with the flow of the air sample in main passageway 18, and exists housing 12 at outlet 16.

As an incipient fire condition develops, the number of particulates 5 microns in size or less in the atmosphere greatly increases. Collector 24 operates on the sample of air in main passageway 18 to separate out these 5 micron and smaller particulates. The flow of these particulates passes into cavity 54 and through ionization chamber 30. The presence of these particulates inhibits the flow of ionized air molecules from radiation source 32 to electrode 36 causing a decrease in ionization current on line 38. Alarm 60 operates to monitor the change in ionization current in chamber 30. Because ionization chamber 40 is not exposed to the particulates, the ionization current on line 48 from ionization chamber 40 is not affected by an incipient fire condition and thus is allowed to function effectively as a reference for changes in humidity, temperature and pressure.

In the present invention, the rate of flow of the air sample in main passageway 18 and the flow of the selected particulates through ionization chamber 30 in cavity 54 are both controlled by the operation of blower or fan 20 in main passageway 18. The size of blower or fan 20 is selected to provide a constant flow of ambient air through main passageway 18. An example of a suitable flow rate is 6 liters per minute. At that controlled rate of ambient air flow, the collector 24, being constructed as taught in the Barr application to extract particulates less than 5 microns in size, will extract a flow of approximately 300 cc/min of air containing only the selectedly small particulates. Since the flow rate of the air is directly dependent on the flow of the ambient air in main passageway 18, the flow rate of the separated air in cavity 54 is also directly controlled by the operation of blower or fan 20.

This controlled rate of flow in cavity 54 results in a number of significant advantages over other ionization fire detectors. In one type of conventional sensor, a diffuser protects the ionization sensing chamber allowing particles in the atmosphere to migrate into and then back out of the sensor only by the process of convection resulting in a static sensing device. This approach is necessary because ionization chambers are inherently extremely sensitive to uncontrolled changes in air current especially when large dust particles are present. In the present invention most dust particles are excluded by the aerodynamic collector 24. Thus ionization chamber 30 is only exposed to selected sub-micron particulates and this exposure is at a controlled, preselected flow through rate equal to approximately four changes of air within the ionization chamber 30 per minute resulting in a dynamic sensing device. This can only be done because the sensing chamber 30 is not exposed to atmospheric dust, dirt, etc. It has been found that the design of the present invention therefore increases the response time of the ionization chamber to an incipient fire condition by a factor greater than 25 over the conventional approach where convection must be relied upon. In addition, the flow of selected particulates through the ionization chamber remains constant regardless of changes in outside conditions. For example, the design has operated successfully in ambient air velocities of up to 3000 ft. per minute.

The increased sensitivity of the ionization chamber 30 due to the controlled rate of flow of selectively small particulates results in a further advantage over other ionization detectors. This advantage arises from the fact that the increased sensitivity allows the reference ionization chamber 40 to be functionally identical, that is to say balanced, with the measuring ionization chamber 30. The increased sensitivity of the sensing chamber caused by the dynamic flow through condition eliminates the need to reduce the size of the reference ionization chamber and operate that chamber at just slightly below saturation. Under those prior art conditions, changes in ambient temperature, pressure or humidity of the magnitude as can be expected when detectors are used in aircraft, space craft or the like, results in unequal operational effects in the two chambers thereby destroying the capacity of the second chamber to function as a reference to the first chamber. In the present invention, the increased sensitivity allows the two chambers to be precisely identical and therefore experience identical operational effects even when exposed to high magnitude changes in ambient temperature, pressure or humidity. Accordingly, the utility of the present invention is enhanced by its capacity to be used in aircraft, space craft and the like environments.

A further advantage of the present invention is derived from the fact that measuring ionization chamber 30 is exposed only to particulates of 5 microns or smaller and isolated from substantially all dust particles of a size greater than 5 microns. Accordingly, the problem of dust settling on the electrode and radiation source of the measuring ionization chamber is eliminated by the present invention and the need to clean the ionization chamber is likewise removed. The small particulates allowed to pass through ionization chamber 30 have been found not to attach themselves to the surfaces of the sensor. By thus eliminating dust, the sensitivity of the measuring ionization chamber is greatly improved and the life substantially lengthened. As a practical matter, the life of the present detector is limited only by the life of motor 22.

A further advantage of the dynamic flow-through sensing chamber over static ionization detector sensing chambers is its ability to follow the progress of the hazardous condition once an alarm is given. In static ionization chamber detectors, smoke particles that diffuse into the sensing chamber take a long time to diffuse back out once the offending condition has been removed thus limiting the detector's usefulness to just the initial alarm. With the dynamic flow-through detector, the sensor responds immediately to ambient conditions thus being able to monitor the progress of the condition after the initial alarm is given.

It will be apparent to those skilled in the art that modifications and variations can be made in the incipient fire detector of the present invention without departing from the scope or spirit of the invention.

What is claimed is:

1. An incipient fire detector comprisng:

a. fluid flow path means for channeling fluid containing particulates generated by incipient fire conditions;

b. means for aerodynamically diverting and collecting from the fluid in said flow path means fluid containing unfiltered particulates having a size less than 5 microns and rejecting substantially all particulates having a size above 5 microns;

c. a flow-through ionization particulate detector having means for directing said diverted fluid through said particulate detector and back into said flow path means;

d. means for generating fluid flow at a controlled rate through said fluid flow path means and through said particulate detector via said directing means; and e. means for providing an output from said ionization particulate detector to permit processing the number of particulates in said diverted fluid sensed by said ionization particulate detector as an indication of an incipient fire condition.

2. An incipient fire detector as in claim 1 wherein said ionization particulate detector includes a sensing ionization chamber of fixed geometric configuration and wherein said fire detector includes a shielded reference ionization chamber of identical configuration to said sensing ionization chamber.

3. An incipient fire detector as in claim 2 also including a leak path between said reference ionization chamber and said fluid flow path means for rendering said reference chamber sensitive to atmospheric changes in temperature, pressure and humidity but for inhibiting migration of particulates into said reference chamber.

4. An incipient fire detector comprising:

a. first and second ionization chambers of identical geometric configuration in back-to-back arrangement;

b. a main passageway for channeling fluid containing particulates generated by incipient fire conditions around at least a portion of the periphery of each of said first and second chambers;

c. aerodynamic means for diverting and collecting from the fluid in said passageway fluid containing unfiltered particulates having a size less than 5 microns and rejecting substantially all particulates having a size above 5 microns;

d. means in the walls in said first ionization chamber for directing said diverted and collected fluid into said first ionization chamber and back out into said main passageway;

e. means for shielding said second ionization chamber;

f. a leak path between said main passageway and said second ionization chamber for rendering said second ionization chamber sensitive to atmospheric changes in temperature, pressure and humidity but inhibiting migration of particulates into said second ionization chamber;

g. a fan for generating fluid flow at a controlled rate through said main passageway and said first ionization chamber via said directing means; and h. means for comparing the outputs of said first and second ionization chambers as an indication of an incipient fire condition.

* * * * *